US006302348B1

(12) United States Patent
Lillelund et al.

(10) Patent No.: US 6,302,348 B1
(45) Date of Patent: Oct. 16, 2001

(54) COUNTER-TOP PAPER TOWEL HOLDER

(75) Inventors: Stig Lillelund, Gentofte; Jakob Heiberg, Charlottenlund, both of (DK)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 09/401,481

(22) Filed: Sep. 22, 1999

(51) Int. Cl.[7] ..... B65H 23/06

(52) U.S. Cl. ..... 242/422.5; 242/597.7; D6/521; D6/522

(58) Field of Search ..... 242/588.2, 597.7, 242/422.5; D6/521, 522

(56) References Cited

U.S. PATENT DOCUMENTS

| | | | |
|---|---|---|---|
| D. 260,061 | 8/1981 | Smith | D6/96 |
| D. 284,152 | 6/1986 | Jerhammar | D6/521 |
| D. 298,597 | 11/1988 | Bell | D6/521 |
| D. 306,809 | 3/1990 | Joseph | D6/521 |
| D. 356,226 | 3/1995 | Hay | D6/521 |
| D. 359,642 | 6/1995 | Ahern, Jr. | D6/521 |
| D. 390,054 | 2/1998 | Goodman | D6/522 |
| D. 394,770 | 6/1998 | Dann, Jr. | D6/522 |
| D. 405,633 | 2/1999 | Joergensen | D6/522 |
| D. 432,827 * | 10/2000 | Lillelund et al. | D6/521 |
| 4,487,376 | 12/1984 | Compton | 242/55.54 |
| 4,720,053 | 1/1988 | Vance | 242/55.54 |
| 4,771,966 | 9/1988 | Anderson | 242/55.2 |
| 5,135,179 | 8/1992 | Morano | 242/55.54 |
| 5,938,141 | 8/1999 | Kanbar | 242/423.1 |

OTHER PUBLICATIONS

U.S. application No. 09/401,481, filed Sep. 22, 1999, Stig Lillelend—Paper Towel Dispenser; Attorney Docket # 130551–D200.

* cited by examiner

*Primary Examiner*—John Q. Nguyen
(74) *Attorney, Agent, or Firm*—Taylor J. Ross

(57) ABSTRACT

A counter-top paper towel holder having a base, a mounting rod extending upward from the base, and a stabilizing extension extending upward from the base at a position radially spaced from the mounting rod. The stabilizing extension includes a handle portion and a presser arm spaced radially outward from the handle potion. The presser arm is resilient, and includes a free end for abutting the roll of paper towels mounted on the mounting rod. Grasping the handle with one hand provides support for the paper towel holder against gross movement as the free towels are pulled from the roll using the other hand. The thumb of the grasping hand may press against the presser arm to force the free end against the roll. The free end thus prevent further rotation of the roll, and assists in breaking the lines of perforation to dispense the towels.

5 Claims, 2 Drawing Sheets

COUNTER-TOP PAPER TOWEL HOLDER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to a holder for paper towels. In particular, the present invention relates to an improved roll paper towel holder for counter-top use.

Rolls of perforated paper towels are a common item in many households. Such rolls typically include a cylindrical cardboard core surrounded by spiral wound paper towels, each separable along a line of perforation parallel to the longitudinal axis of the core. Holders for such rolls are commonly mounted beneath cabinets or on vertical walls with the longitudinal axis extending horizontally. It is also known to provide a counter-top holder for such rolls.

The usual counter-top roll holder consists of a base mounting a vertical mounting rod. The core is received over the mounting rod and will rotate thereabout during dispensing. The base maintains the mounting rod, and thus the roll, upright during dispensing. To ensure this upright position, the user will often grasp the upper end of the mounting rod.

While this arrangement is acceptable, it does have disadvantages. To separate the towels from the roll, it is often necessary to grasp the roll to prevent its rotation. This may be achieved while grasping the upper end of the mounting rod, but can result in soiling of the upper end of the roll. Additionally, the initial tearing of towels along the perforation line is sometimes difficult, and is aided by applying pressure to the roll adjacent the perforation line. This requires that the user not only hold the upper end of the roll, but hold the upper end of the roll at a position to apply this pressure at the correct location. This further present a problem of soiling the roll adjacent the perforation line as well.

SUMMARY OF THE INVENTION

An object of the present invention is to provide a paper towel holder which permits dispensing of paper towels.

Another object of the present invention is to provide such a holder which is simple and easy to use.

Another object of the present invention is to provide such a holder which is stable, and which assists in the breaking of perforation lines.

These and other objects are achieved by a counter-top paper towel holder having a base, a mounting rod extending upward from the base, and a stabilizing extension extending upward from the base at a position radially spaced from the mounting rod. The stabilizing extension includes a handle portion and a presser arm spaced radially outward from the handle potion. The presser arm is resilient, and includes a free end for abutting the roll of paper towels mounted on the mounting rod. Grasping the handle with one hand provides support for the paper towel holder against gross movement as the free towels are pulled from the roll using the other hand. The thumb of the grasping hand may press against the presser arm to force the free end against the roll. The free end thus prevent further rotation of the roll, and assists in breaking the lines of perforation to dispense the towels.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
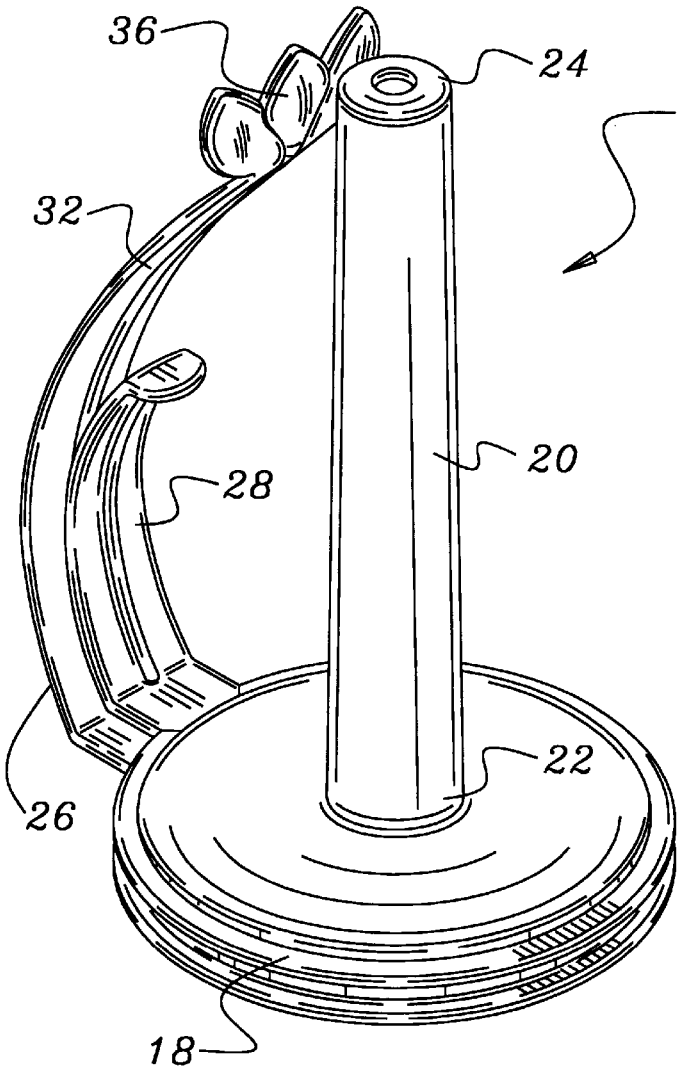
FIG. 1 is a perspective view of a paper towel holder according to the present invention.
Figure 2:
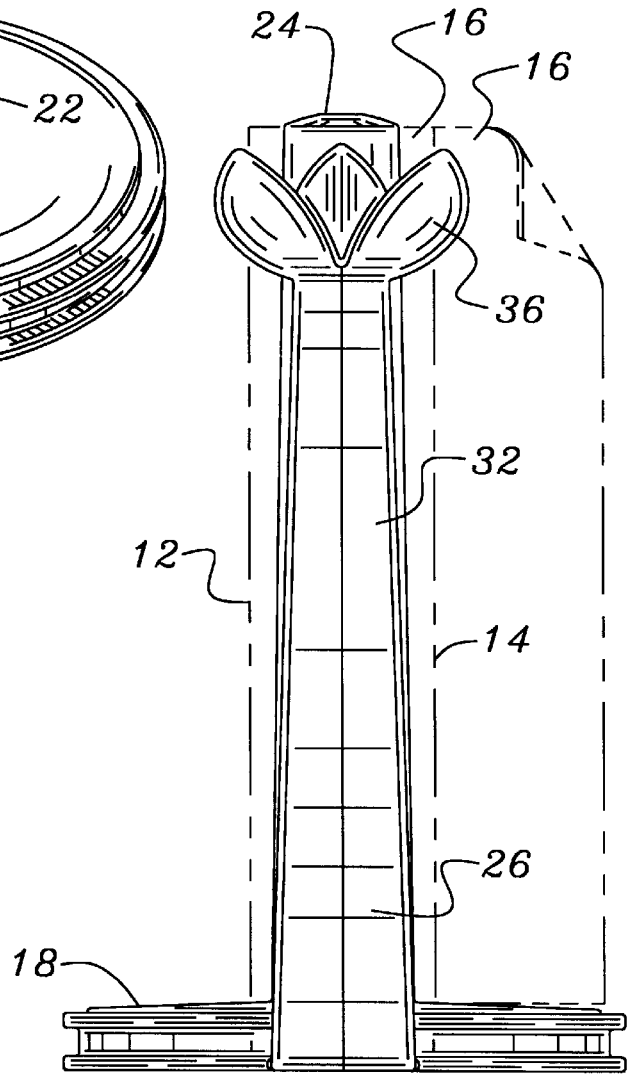
FIG. 2 is a front view of the paper towel holder of FIG. 1.

With reference to FIG. 1, a paper towel holder according to the present invention is generally designated by reference numeral 10. The paper towel holder 10 is intended for counter-top use to hold a roll of paper towels 12 (FIG. 2). Such rolls 12 include a cardboard core (not shown) having a tubular form which supports a length of absorbent paper wound thereabout in a spiral. This paper includes lines of perforation 14, extending essentially parallel to the longitudinal axis of the core, at predetermined lengths to form a plurality of individual towels 16.

The paper towel holder 10 includes a base 18 intended to rest upon a counter-top or similar supporting surface. While the base 18 may have a variety of peripheral shapes, circular having a diameter slightly larger than that of the full roll 12 is preferred. Extending upward from the base 18 is a mounting rod 20. The mounting rod 20 may have a various peripheral shapes, but is again preferably circular, and also preferably has a slight inward taper from a lower end 22 towards an upper end 24. The mounting rod 20 preferably extends from a central portion of base 18, and may be coaxial with a circular base.

Figure 3:
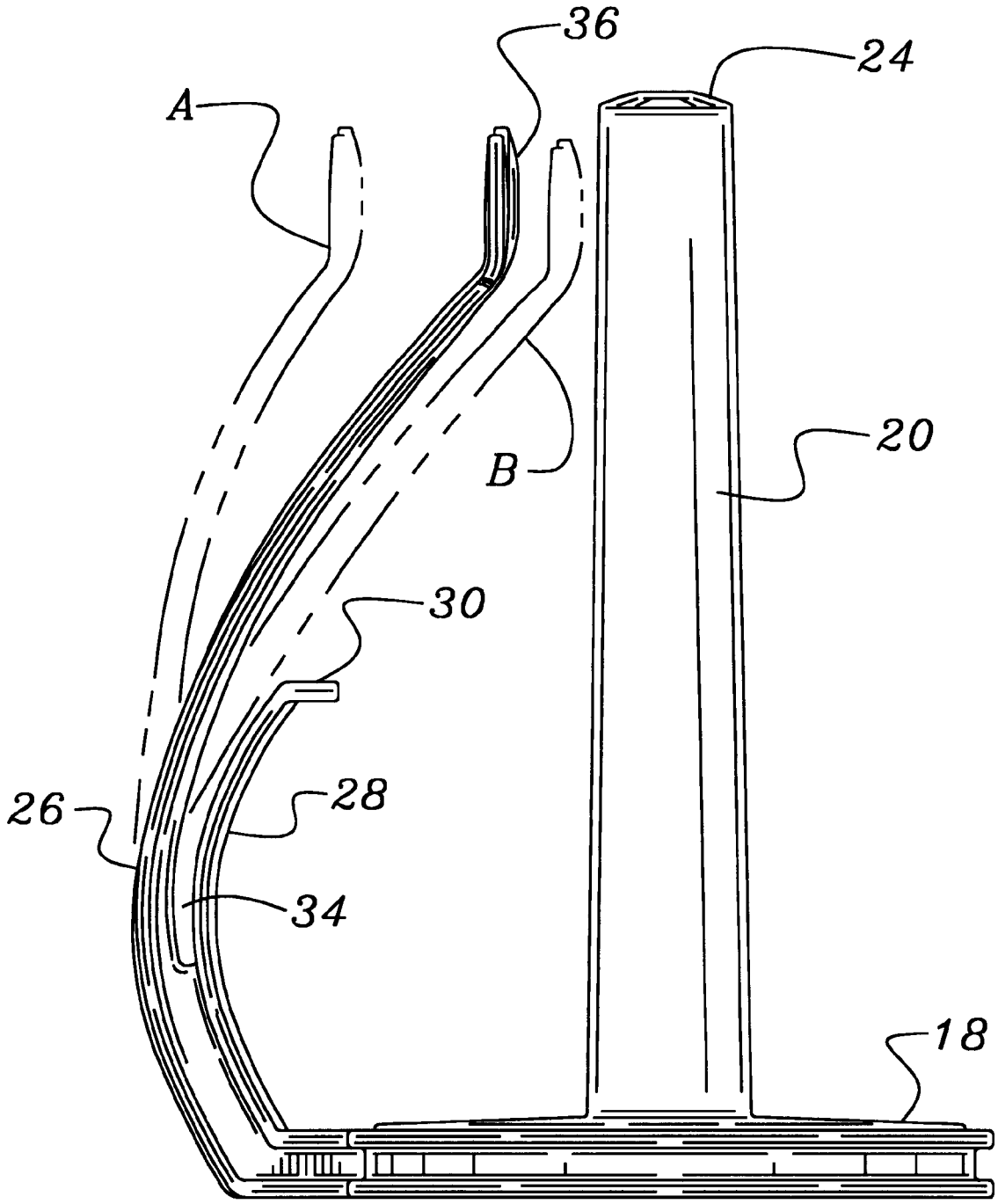
FIG. 3 is a side view of the paper towel holder of FIG. 1.

As best illustrated in FIGS. 2 and 3, the roll 12 may be mounted upon the mounting rod 20 with the core receiving the mounting rod 20 and one longitudinal end of the roll 12 abutting the base 18. The towels 16 will thus be pulled manually from the roll 12 to extend tangentially therefrom. This manual force will serve to support the towels 16 against falling downward under their own weight, maintaining them generally within a plane of the tangent. An increased manual force in the same direction will serve to break the lines of perforation 14 to separate one or more towels 16 from roll 12.

The arrangement described to this point is well known in the art. In the present invention, however, there is provided an arrangement for automatically providing a force for supporting the towels 16 against falling, and for assisting in separating the towels 16 along the lines of perforation 14.

This arrangement consist of a stabilizing extension 26 extending upward from the base 18. The stabilizing extension 26 includes a handle portion 28 extending upward from the base 18 to a top end 30. The handle portion 28 extends from the base 18 at a position spaced radially outward from the longitudinal axis of mounting rod 20 a distance sufficient to permit a user's fingers to be inserted between the handle portion 28 and a full roll 12 when mounted upon mounting rod 20. In other words, the handle portion 28 is spaced from the longitudinal axis of the mounting rod 20 by a distance greater than the radius of an average roll 12. As may be envisioned, the handle portion 28 may thus be grasped by the user to provide stability for the paper towel holder 10 during use.

The stabilizing extension 26 also includes a presser arm 32 spaced radially outward from handle portion 28, as by a gap 34 (FIG. 3). It is noted that the gap 34 may extend fully to the base 18, or may begin at a position spaced therefrom, as shown. The presser arm 32 extends beyond the top end 30 of handle portion 28 to a free end 36. The presser arm 32 preferably has a height such that the free end 36 is located adjacent the upper end 24 of mounting rod 20. The presser arm 32 also curves inward toward mounting rod 20 such that in its relaxed position the free end 36 of presser arm 32 is located radially inward of handle portion 28. As shown, in FIG. 3, it is preferred that the free end 36 be spaced radially outward from the mounting rod 20 when in the relaxed position shown by solid line. This is not required however, and the free end 36 could abut the mounting rod 20 when relaxed.

The presser arm 32 is resiliently mounted to the base 18, or is formed of a resilient material such a plastic, to permit it to flex radially as illustrated by the dashed lines of FIG. 3. As such, the presser arm 32 may flex radially outward to position A to abut against the roll 12 when it is full. The resilient nature of the presser arm 32 will tend to force it inward towards the relaxed position, however, such that the free end 36 will exert a force against the roll 12. As may be envisioned, the free end 36 may thus serve to hold the towels 16 against falling under their own weight, presenting a full edge for manual grasping by the user to ease use, and also presenting a pleasing appearance. The free end 36 will continue to apply this force against the roll 12 until the roll 12 is depleted to a point such that its outer radius is spaced within the relaxed position (which may not occur depending upon the relaxed position chosen during design).

The resilient nature of the presser arm 32, together with the placement of handle portion 28 also permits an additional use for the free end 36. Specifically, the force applied due to the resiliency of presser arm 32 will hold the towels 16 against collapse, but is not sufficient to provide significant assistance in breaking the lines of perforation 14. This force may be increased, however, by the user to provide such assistance.

In particular, the user may manually press against the presser arm 32 in a radially inward direction to force the free end 36 against roll 12 with greater force, as illustrated by position B in FIG. 3. This greater force may be sufficient to hold the roll 12 against rotation, such that the user may break the lines of perforation 14 by manually pulling the unrolled towels 16 (those extending beyond the free end 36) in the tangential direction. The inner face of the free end 36 may include knurling or other friction increasing treatment to assist in this.

Further, if the free end 36 is located in its preferred position adjacent upper end 24 of mounting rod 20, the free end 36 will be located adjacent the upper longitudinal end of the roll 12, and thus adjacent the edge of the towels 16. This positioning is advantageous in that the user may unroll the towels 16 until the desired line of perforation 14 is just past the free end 36, as illustrated in FIG. 2. The user may then manually pull the towels 16 not simply in the tangential direction, but also radially outward. This reduces the possibility of the roll 12 rotating, and provides easier breaking of the lines of perforation 14.

The manual force applied by the user to move the presser arm 32 radially inward is easily applied due to the placement of the handle portion 28. Specifically, the user's fingers may rest upon the handle portion 28 with the thumb of the same hand resting upon the outer face of the presser arm 32. A simple squeezing action of that hand will then cause the desired deflection of the presser arm 32 radially inward. While the handle portion 28 may deflect outward during this squeezing, the greater length of the presser arm 32 will typically ensure sufficient deflection. Additionally, the handle portion 28 may of course be designed for less resilience.

The handle portion 28 was noted above to increase stability of the entire paper towel holder 10. As such, with one hand the user may prevent gross movement of the paper towel holder 10 while also applying pressure to the outer face of the roll 12. This frees the user's other hand to grasp and pull the towels 16. This arrangement is believed to provide an effective and convenient dispenser for paper towels. Additionally, the paper towel holder 10 is of simple design permitting reduced manufacturing cost. In fact, the entire device may be made of a monolithic piece of plastic using injection molding techniques. Finally, the presser arm 32 and free end 36 are visible during use, permitting decorative features to be added thereto to increase the aesthetics of the paper towel holder 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A counter-top paper towel holder, comprising:

a base;

a mounting rod extending upward from said base and sized to receive thereon a core of a roll of spiral-wound paper towels separated by lines of perforation;

a handle portion extending upward from said base to a top end, said handle portion extending from said base at a position spaced a first distance from a longitudinal axis of said mounting rod, said first distance being greater than a radius of said roll; and a presser arm extending upward from said base to a free end, said presser arm being spaced radially outward from said handle portion, said free end being resiliently biased toward a relaxed position a second distance from said longitudinal axis, said second distance being less than said first distance.

2. A counter-top paper towel holder as in claim 1, wherein said presser arm is formed of a resilient material.

3. A counter-top paper towel holder as in claim 1, wherein said presser arm has a length such that said free end is adjacent an upper end of said mounting rod.

4. A counter-top paper towel holder as in claim 3, wherein said presser arm is formed of a resilient material.

5. A counter-top paper towel holder as in claim 4, wherein said base, mounting rod, handle portion and presser arm are formed as a monolithic piece of plastic.

* * * * *